US007883038B2

(12) United States Patent
Migliaccio

(10) Patent No.: US 7,883,038 B2
(45) Date of Patent: Feb. 8, 2011

(54) DEVICE TO REDUCE CLOGGING OF GUTTERS

(76) Inventor: Michael Migliaccio, 43 Valley Dr., Greenwich, CT (US) 06831

( * ) Notice: Subject to any disclaimer, the term of this patent is extended or adjusted under 35 U.S.C. 154(b) by 0 days.

(21) Appl. No.: 12/454,966

(22) Filed: May 27, 2009

(65) Prior Publication Data

US 2009/0283618 A1 Nov. 19, 2009

Related U.S. Application Data

(63) Continuation-in-part of application No. 12/069,148, filed on Feb. 6, 2008.

(51) Int. Cl.
*B02C 23/36* (2006.01)

(52) U.S. Cl. ..... 241/46.017; 241/282.1; 241/282.2; 52/16

(58) Field of Classification Search ..... 241/46.017, 241/282.1, 282.2; 52/11–16; 15/236.01, 15/236.04
See application file for complete search history.

(56) References Cited

U.S. PATENT DOCUMENTS

| | | | | |
|---|---|---|---|---|
| 2,753,121 | A * | 7/1956 | Elfenbein | 241/32.5 |
| 3,459,247 | A * | 8/1969 | Goodman | 241/38 |
| 3,638,369 | A * | 2/1972 | Albrecht | 52/16 |
| 4,029,262 | A * | 6/1977 | Lazich et al. | 241/43 |
| 4,052,009 | A * | 10/1977 | Penque | 241/1 |
| 7,568,640 | B2 * | 8/2009 | Rademacher | 241/21 |

* cited by examiner

*Primary Examiner*—Bena Miller
(74) *Attorney, Agent, or Firm*—Skadden, Arps, Slate, Meagher & Flom LLP

(57) ABSTRACT

A device for reducing clogging of a gutter comprises a housing which fits in a gutter over the downspout. The device contains a motor-driven grinder mechanism which grinds up waterborne leaves and other debris passing through the housing, preferably as they exit through the outlet of the housing to the downspout. The grinder mechanism preferably comprises one or more rotary type blades located above an inlet of the downspout. The device may also include a plunger mechanism which helps push water and debris in the housing through the grinder mechanism. Also, preferable the device includes a water sensor and a debris sensor for operating the motor only when both water and debris are present.

9 Claims, 4 Drawing Sheets

DEVICE TO REDUCE CLOGGING OF GUTTERS

CROSS-REFERENCE TO RELATED APPLICATIONS

This application is a continuation-in-part of U.S. patent application Ser. No. 12/069,148, filed on Feb. 6, 2008.

BACKGROUND OF THE INVENTION

Many residential homes and other buildings are fitted with rain gutters. Rain gutters divert rain water flowing off the roof to a downspout, and thus prevent rain water from dripping off the eaves directly onto the ground. Without gutters, accumulated rain water will fall along a line directly under the eave. This can form an unsightly drip line under the eave, and may damage a lawn or other plantings next to the house. Rain gutters also prevent rain water from falling from the roof onto persons entering or leaving the house.

An age-old problem with rain gutters is blockage due to leaves and other debris. This problem is particularly acute in the fall, when leaves which have fallen on rooftops are washed down by rainfall into the gutters and are carried from there to the mouth of the downspout. Wet leaves easily stick together and can accumulate at the mouth of the downspout, clogging the downspout and causing water to back up into the gutter and overflow.

For such reasons, gutters must periodically be cleaned of debris, particularly in the area near the downspout connection. This usually involves climbing a ladder and using tools and/or pressurized water to remove manually the compacted organic matter. Aside from the inconvenience involved, there is the danger of falling while handling tools or a hose at the top of a ladder, and the possibility that a gutter may be damaged by the weight of the ladder and the person on it. The risk of falling is particularly troubling in the case of multi-story buildings, where a fall could cause serious injury.

One known way to try to reduce clogging in gutters is covering the gutter with a protective screen. Such technique, however, is not entirely effective. Wet leaves which are washed off the roof can stick to the protective screen, blocking the screen openings. When this happens, rain water cannot flow into the gutter, thus defeating the purpose of having a gutter.

Albrecht U.S. Pat. No. 3,638,369 discloses a device for clearing a gutter downspout. An auger device is located in the gutter, above the downspout, such that the auger screw extends a short distance down into the downspout. The shaft of the auger screw is connected to an impeller, located above the gutter, such that when the wind blows, the impeller rotates the screw shaft, and the rotating screw in turn forces downwardly any solid matter with which it is in contact.

Albrecht only works while the wind is blowing. If it is raining, and there is insufficient wind to rotate the screw, water-soaked leaves and other sticky debris may accumulate at the downspout inlet, clogging the downspout inlet. The auger screw, in fact, makes a blockage more likely, both because the screw partially blocks the downspout opening, and because the screw surfaces are substantially perpendicular to the direction of flow, and thus likely to attract the wet, sticky leaves.

If waterlogged organic matter does accumulate around the screw, when the wind again starts to blow it will be harder to start the screw rotating, particularly if it has stopped raining and the matter has partially dried out and hardened. Thus, the auger may become stuck and need to be manually cleaned before it will work again.

In Albrecht, even when the auger is operational, leaves and other debris may clog the downspout at its lower end, because the auger pushes the organic mass downwardly generally intact. The auger may actually exacerbate the tendency to clog, insofar as the screw compacts the organic mass while extruding it through the downspout inlet.

There is a need for a more effective system for keeping gutters clear. There is also a need for such a system which does not require climbing ladders and, preferably, other human intervention.

BRIEF SUMMARY OF THE INVENTION

A device for reducing clogging of a gutter comprises a housing which fits in a gutter over the downspout. The device contains a motor-driven grinder mechanism which grinds up waterborne debris passing through the housing, preferably as it exits through the bottom of the housing to the downspout. The grinder mechanism preferably comprises one or more rotary type blades located above an inlet of the downspout. The device may also include a plunger mechanism which helps push water and debris in the housing through the grinder mechanism. Also, preferable the device includes a water sensor and a debris sensor for operating the motor only when both water and debris are present.

For a better understanding of the invention, reference is made to the following detailed description of the preferred embodiments of the invention, taken in conjunction with the drawings accompanying the application.

DETAILED DESCRIPTION OF THE INVENTION

Figure 1A:
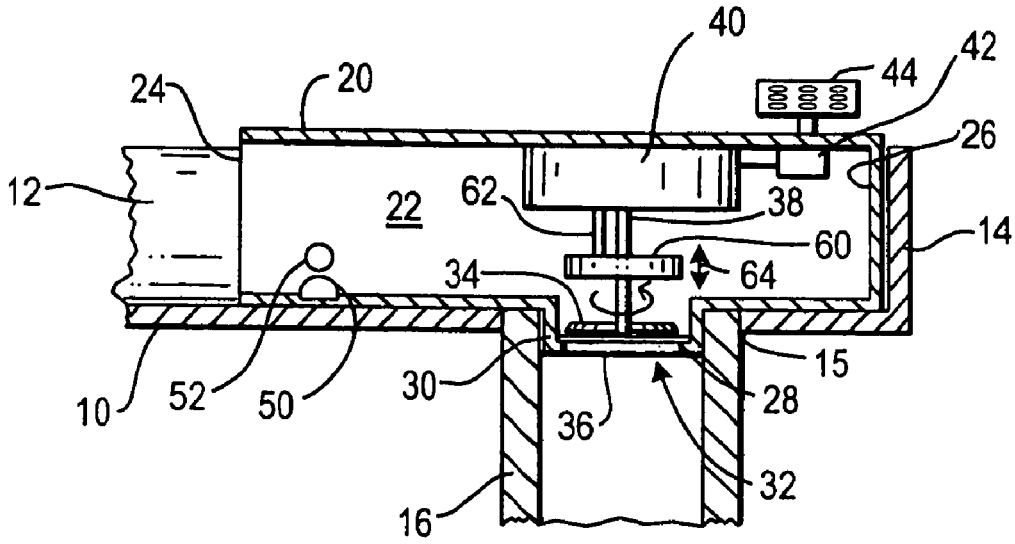
FIG. 1A is a schematic drawing of an embodiment of a device according to the present invention.

FIG. 1A shows a portion of a conventional eaves gutter 10. The gutter 10 has a channel 12 which is normally generally U-shaped or semi-circular in cross-section, and an end wall 14. It also has a hole 15 for receiving the upper end of a downspout 16 so that rainwater in the gutter 10 flows from the gutter into the downspout 16.

The device according to the present invention includes a housing 20 having a lower portion 22 designed to fit within a conventional gutter 10, i.e., being generally arcuate cross-section. In the embodiment shown, one end 24 of the housing 20 is open so as to communicate with the channel 12 and allow water and debris present in the gutter 10 to flow into the housing 20. The other end 26 of the housing is preferably closed.

The bottom of the lower portion 22 of the housing 20 includes an outlet 28 located such that, when the housing 20 is placed in the gutter 10, outlet 28 communicates with the inlet of the downspout 16, as shown. The outlet 28 may be at the bottom of a vertically oriented tubular wall section 30 which fits snugly inside the downspout 16. The wall section 30 helps seat the housing at the proper angle, secures the housing 20 against movement, and provides leak-free communication between the housing 20 and the downspout 16.

The device contains a grinding mechanism 32 which is preferably located near the outlet 28 of the housing 20. In the embodiment of FIG. 1A, the grinding mechanism 32 is in the form of one or more rotatable blades 34. A screen or grid 36 may be located between the blades 34 and outlet 28. The screen or grid 36 may be used to prevent large particles of leaves or other debris from entering the downspout 16 until they have been sufficiently ground up by the blades 34. The blades 34 may also rub against the screen or grid 36 to help grind up particles.

The blades 34 are secured on a drive shaft 38, which is received in a motor housing 40. The motor housing 40 contains an electric motor and, if desired, appropriate gearing for driving the shaft 38 at a speed effective to grind up leaves and other debris that may fall into the gutter 10 and be carried into the housing 20. The motor is connected to any suitable power source, for example a battery 42 which may be charged by a solar panel 44. Solar-powered battery charging systems are well known and need not be described here. Alternately, the motor may be powered by a conventional house current power line or other power source.

Figure 2:
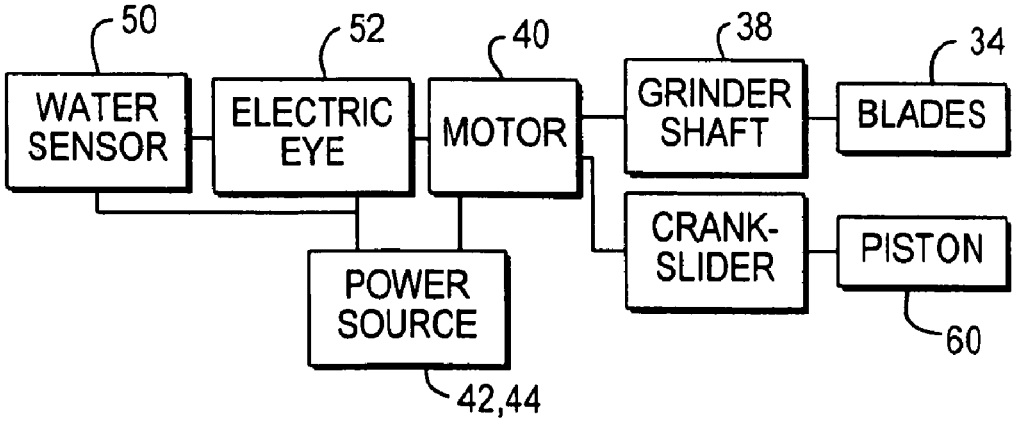
FIG. 2 is a block diagram of the devices of FIGS. 1A and 1B.
Figure 1B:
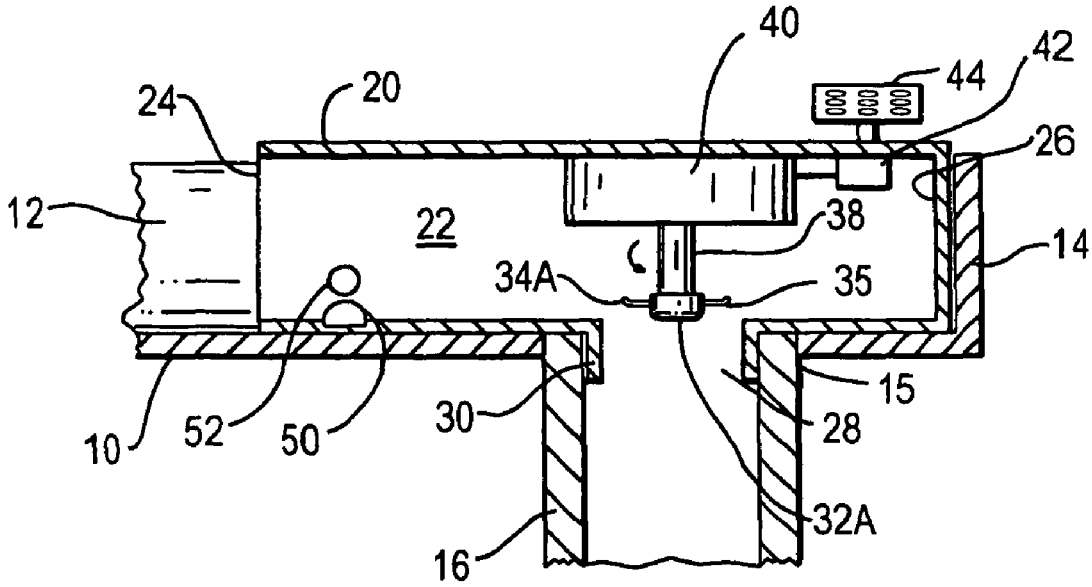
FIG. 1B is a schematic drawing of an alternate embodiment of a device according to the present invention.

Operation of the motor may be controlled manually, i.e., turned on while it is raining. Preferably, however, operation of the motor is automatically controlled, and turned on only when detectors sense the presence of waterborne debris. In the embodiment of FIGS. 1A, 1B and 2, a water detector 50 is disposed inside the housing either in or on the bottom surface. Water detectors are well known devices, e.g., are commonly used in connection with sump pumps, and need not be described further here. The presence of debris in the water may be sensed using an electric eye and detector 52 mounted in or on the side of the lower portion 22. If the electric eye and detector 52 are one unit, a mirror is placed on an opposite wall of the housing to reflect back the signal, which will be partially blocked when debris is present. Also, electric eye systems are well known and used for various applications.

According to another aspect of an alternate embodiment, the housing 20 contains a plunger mechanism comprising a piston 60 coupled to a piston rod 62. The upper end of the piston rod 62 is received in the motor housing 40 and moved vertically up and down, as shown by arrow 64, so that the piston acts to push water and debris towards the grinder mechanism 32. In order to allow the piston 60 to move up and down free of the rotating drive shaft 38, a hole is provided through the piston, through which the drive shaft 38 passes.

Any suitable drive mechanism may be used to reciprocate the piston 62. For example, the piston may be driven off the same motor that rotates the shaft 38, using a connecting linkage such as a crank and slider (as indicated in FIG. 2) or a cam mechanism, along with appropriate plastic gears. Alternately, the shaft 62 may be driven by a separate motor/linkage or a servo. Mechanisms for driving a shaft in translation are well known and need not be described further here. Moreover, the mechanism for moving the piston 60 need not be a fixed shaft. Any other suitable drive mechanism, such as a flexible drive shaft, spring mechanism, or solenoid, may be employed.

The blades 34 are secured on a drive shaft 38, which is received in a motor housing 40. The motor housing 40 contains an electric motor and, if desired, appropriate gearing for driving the shaft 38 at a speed effective to grind up leaves and other debris that may fall into the gutter 10 and be carried into the housing 20. The motor is connected to any suitable power source, for example a battery 42 which may be charged by a solar panel 44. Solar-powered battery charging systems are well known and need not be described here. Alternately, the motor may be powered by a conventional house current power line or other power source.

FIG. 1B shows an alternate embodiment in which grinding mechanism 32A is located near the outlet 28 of the housing 20, and is preferably positioned near the inlet of the downspout 16. More preferably, the grinding mechanism 32A is positioned slightly above the inlet of the downspout 16, as shown. However, grinding mechanism 32A may also be positioned within the downspout 16. In the embodiment shown in FIG. 1B, the grinding mechanism 32A is in the form of one or more blades 34A. A screen or grid (not shown) may be located between the blade(s) 34A and outlet 28. The blade(s) 34A are preferably rotary type blades, and more preferably curved at the edges 35, either upwardly or downwardly. The blade(s) 34A are preferably situated above the inlet of the downspout 16 as shown, and may extend beyond the diameter of the outlet 28. If the blade(s) 34A are situated within outlet 28, they obviously would need to fit within the diameter of outlet 28. The blade(s) 34A are secured on a drive shaft 38, which is received in a motor housing 40, as discussed above with respect to FIG. 1A.

Referring to FIG. 2, the water sensor 50 and associated electronics act as a normally open switch, which prevents the motor (and separate drive for the plunger, if present) from operating unless water is present inside the housing 20. The electric eye system 52 and associated electronics act as a normally open switch which prevents the motor from operating unless the beam from the electric eye system 52 is blocked or partially blocked, which will occur if debris is present in the water. In such a manner, the motor will not run unless it is raining and also there is debris inside of the housing 20.

Figure 3:
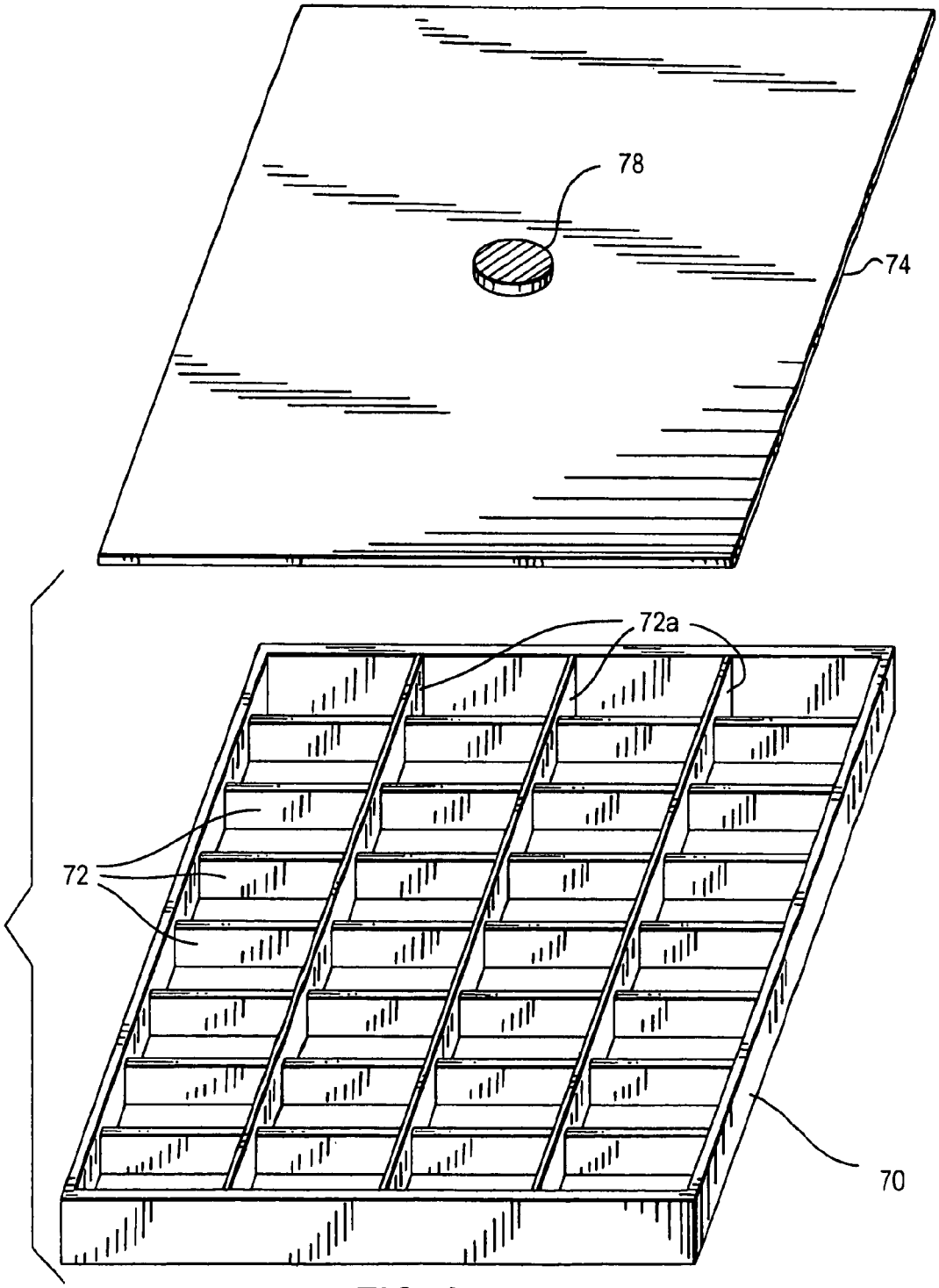
FIG. 3 is a schematic drawing of an alternative grinding mechanism for use in the present invention.

FIG. 3 shows an alternative embodiment of a grinding mechanism. A housing frame 70, which is open at its top and bottom ends, secures a grid of blades 72 and optional cross-blades 72*a*, whose sharp edges face upwardly in FIG. 3. The cross-blades 72*a* are preferably perpendicular to the blades 72, but other angles may be employed. A plunger 74 is positioned above the blades 72, 72*a*, and is reciprocated by connecting its plunger rod 76 to a motor (not shown). The frame 70 is positioned so that water and debris from the gutter must pass through the grid of blades; the plunger 74 helps push the debris through the grid of blades, thereby grinding or shredding the debris. As used herein, the term "grinding" refers broadly to any process of reducing the size of the solid matter in the debris, including grinding, shredding, and the like.

Figure 4:
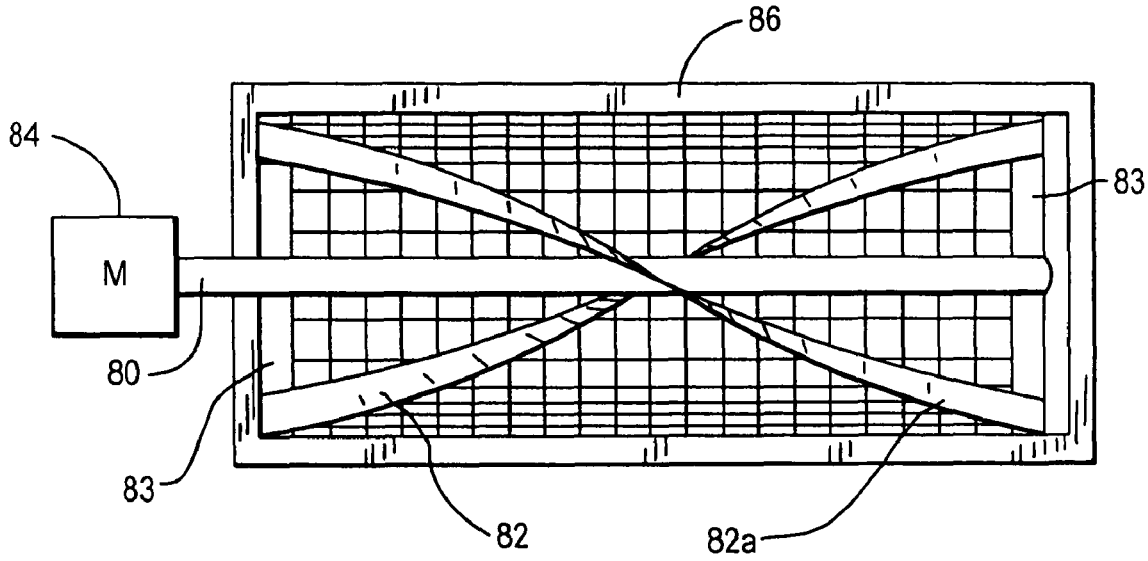
FIG. 4 is a top, schematic view of another grinding mechanism for use in the invention.

FIG. 4 shows another alternative embodiment of a grinding mechanism. A shaft 80 includes a plurality of helical blades 82, 82*a*, which are mounted by struts 83 on the shaft for rotation therewith (i.e., similar to a reel-type lawn motor). One end of the shaft 80 is coupled to a motor 84 for rotating the shaft 80 and thereby the blades 82, 82*a*. The blades 82, 82*a* are positioned in a half-cylinder shaped mesh grid 86, such that the blade edges are close to, or in contact with, the grid surface. The mesh grid 86 is positioned in the path of the flowing water and debris. Thus, as debris flows through the mesh grid 86, it is ground up by the rotating blades 82, 82*a*.

The foregoing represent preferred embodiments of the invention. Variations and modifications will be apparent to persons skilled in the art, without departing from the inventive concepts disclosed herein. For example, while the example of the grinding mechanism employs rotating blades, optionally in conjunction with a screen or grate, any suitable grinding mechanism may be used. It may be desirable to use a miniaturized version of a kitchen garbage disposal unit, insofar as such devices are especially designed to grind up solids in the presence of water.

Alternatively, rather than using rotating blades 34 and a stationary grate, the opposite can be used. By way of example, the grate 36 may be provided with sharp projections, similar to a cheese grater, and a grinding plate may be secured to the bottom end of the rotating shaft 38. In this manner, the rotating plate grinds the debris into the cutting edges of the grate.

As another alternative, the grinder mechanism may be a plurality of parallel blades which are reciprocated in an axial direction, out of phase with one another. The cutting edges of the blades, which may be serrated, face upwardly so that the oppositely moving blades grind up the organic matter as it passes through the blade grid.

In addition, the end 24 of the housing 20 which communicates with the gutter channel 12 need not be completely open, or may communicate with the gutter channel 12 in some other way. The opposite end 14 of the housing 20 need not be closed, because the end wall 14 of the gutter 10 will largely prevent water from escaping anyway.

Also, while in the exemplary embodiment the grinding mechanism is positioned within a tubular section 30 leading to the outlet 28, it is only necessary that the grinding mechanism be positioned in the housing so that a substantial amount of the waterborne debris passes through the grinding mechanism prior to exiting to the downspout. Most preferably, however, the grinding mechanism is located slightly above or in the outlet 28, i.e., within the section 30, or directly above or below section 30, so as to use gravity to help feed in the water-borne debris. Also, while in the exemplary embodiment the downspout is shown as directly connected to the gutter, such is a schematic representation only, insofar as it is well known that in practice there is normally an intervening connector. All such modifications and variations are intended to be within the scope of the invention, as defined in the following claims.

What is claimed is:

1. A device having an outlet coupled to a downspout, wherein said device comprises:

a housing having a lower portion, wherein said housing has an end which is at least partially open for admitting water, and wherein said housing has an outlet in said lower portion which may be aligned with an inlet to the downspout;

a motor secured relative to said housing and having an outlet shaft;

a grinder mechanism operable by said outlet shaft, wherein said grinder mechanism has at least one blade positioned near said outlet; and a plunger mechanism that actively pushes water and debris in said housing towards said outlet.

2. The device recited in claim 1, wherein said at least one blade is mounted in a substantially horizontal position.

3. The device recited in claim 2, wherein said at least one blade has a tip, said tip being curved.

4. The device recited in claim 1, wherein said grinder mechanism has a plurality of blades.

5. The device recited in claim 1, wherein said at least one blade is located above said inlet to said downspout.

6. The device recited in claim 5, wherein said downspout has a first diameter and said at least one blade has a tip which when rotated forms a second diameter, said second diameter being greater than said first diameter.

7. The device recited in claim 1, further comprising a water sensor coupled to said housing for activating said motor only when water is present in said housing.

8. The device recited in claim 1, further comprising a sensor for detecting the presence of debris within said housing and for permitting activation of said motor only when debris is present.

9. The device as recited in claim 7, further comprising a sensor for detecting the presence of debris within said housing and for permitting activation of said motor only when both water is present in said gutter-housing and said debris is present in said housing.

* * * * *